US007721899B2

(12) United States Patent
Lambert

(10) Patent No.: US 7,721,899 B2
(45) Date of Patent: May 25, 2010

(54) TOOTHBRUSH HOLDER

(76) Inventor: Edward L. Lambert, 4502 Morrisville Rd., Bealeton, VA (US) 22712

( * ) Notice: Subject to any disclaimer, the term of this patent is extended or adjusted under 35 U.S.C. 154(b) by 294 days.

(21) Appl. No.: 11/869,190

(22) Filed: Oct. 9, 2007

(65) Prior Publication Data

US 2008/0251475 A1 Oct. 16, 2008

Related U.S. Application Data

(60) Provisional application No. 60/856,855, filed on Nov. 6, 2006.

(51) Int. Cl.
*A47B 81/02* (2006.01)

(52) U.S. Cl. ..... 211/65; 211/66; 211/70.1; 211/87.01; 211/119.009; 211/13.1; 248/110

(58) Field of Classification Search ..... 211/65, 211/66, 69, 69.1–69.9, 70.1, 70.3, 87.01, 211/119.009; 248/110; D4/104–113; D6/524–534; 206/368
See application file for complete search history.

(56) References Cited

U.S. PATENT DOCUMENTS 1,129,363 A 2/1915 Schreiner
1,205,311 A 11/1916 Wybaillie
D184,012 S 12/1958 Hvale et al.
3,802,844 A * 4/1974 Sendra et al. ..... 422/104
4,407,417 A * 10/1983 Boyle ..... 211/69.1
D297,692 S 9/1988 Martinez
5,620,104 A * 4/1997 Maglione ..... 211/59.1
5,769,245 A * 6/1998 Butler ..... 211/65
D477,734 S 7/2003 Snell
6,786,342 B2 * 9/2004 Tayebi ..... 211/65

* cited by examiner

*Primary Examiner*—Sam Chuan C Yao
*Assistant Examiner*—Patrick Hawn
(74) *Attorney, Agent, or Firm*—The Marbury Law Group PLLC

(57) ABSTRACT

A toothbrush holder supports one or more toothbrushes in an equilibrium position between a retention cavity in an inclined base wall and a corresponding recess in an edge of a top wall. The retention cavity is preferably a hole in the inclined base wall and the recess in the top wall is preferably arcuate. The top wall is supported by a rear wall between the inclined base wall and the top wall. Support legs extending from the back of the rear wall allow the holder to be freestanding. Attachment means on a vertical upper portion of the rear wall allow the holder to be secured to a wall. The walls of the holder can be made from a single sheet of material, such as acrylic sheet or metal sheet.

13 Claims, 1 Drawing Sheet

TOOTHBRUSH HOLDER

RELATED APPLICATIONS

This application claims the benefit of U.S. Provisional Application Ser. No. 60/856,855, filed Nov. 6, 2006, which is hereby incorporated by reference for all purposes.

BACKGROUND

Traditional toothbrush holders have usually consisted of a plurality of oblong openings, typically in the periphery of a cup holder, as found in U.S. Pat. No. Des. 184,012, in which the handle of a manual toothbrush is inserted into the opening. Variations of this type of holder use spring-biased grippers to grip the handle of a manual toothbrush, such as in U.S. Pat. No. 1,205,311, and those that use slots to engage the handle of a manual toothbrush, as found in U.S. Pat. No. 1,129,363.

More recently, toothbrushes with non-standard handles have become popular. Such brushes include juvenile toothbrushes with cartoon character handles, such as the Colgate® SpongeBob Squarepants™ Children's Toothbrush and the Crest® Sesame Street Kids' Toothbrush, and battery-powered toothbrushes, such as the Colgate Motion and Crest SpinBrush®. Unfortunately, the handle designs of these toothbrushes make them impossible to store in traditional toothbrush holders that were originally designed for ordinary manual toothbrushes. The shapes of these oversized toothbrush handles also make them difficult or impossible to stand the toothbrush on end. Because of this, many of these toothbrushes end up being laid down on a bathroom countertop where they make a mess and can come into contact with a non-hygienic surface. What would be desirable is toothbrush holder that can hold all types of toothbrushes, including those with oversized handles, in a hygienic manner.

BRIEF SUMMARY

The present invention is drawn to a support for holding virtually all types of toothbrushes and more particularly to a toothbrush holder that can hold toothbrushes with oversized handles, such as battery-powered toothbrushes, in a hygienic manner. Embodiments of the toothbrush holder can be formed of attractive sheet material, such as acrylic or metallic sheet, and can be free-standing for use on countertops, wall-mounted, or a combination thereof.

Embodiments of the toothbrush holder include an angled base wall with a plurality of toothbrush retention cavities, a first angled portion of rear wall, a second substantially-vertical portion of rear wall, and a substantially horizontal top wall. The top wall includes a plurality of recesses on a front edge corresponding with each of the toothbrush retention cavities in the base wall, but offset in a rearward direction. In use, the base of a toothbrush is held in place by a retention cavity and leaned rearward so that an upper portion is supported in an equilibrium position by the corresponding recess in the top wall.

Embodiments of the holder can further include additional details such as: drainage or weep holes at the intersection of the base wall and the first angled portion of rear wall; holes in the second substantially vertical portion of rear wall for fastening the holder to a wall; double-sided adhesive strip on an outside of the second substantially vertical portion of rear wall for fastening the holder to a wall; and one or more support legs extending from an outside of the first angled portion of rear wall.

DETAILED DESCRIPTION

Embodiments of the invention are related to a toothbrush holder that can accommodate both traditional manual toothbrushes and those with oversized handles, such as found in battery-powered toothbrushes. A lower portion of a toothbrush is retained in place and an upper portion of the toothbrush is leaned into a recess, wherein gravity and friction act to hold the toothbrush in a generally upright position that allows drainage.

Figure 1B:
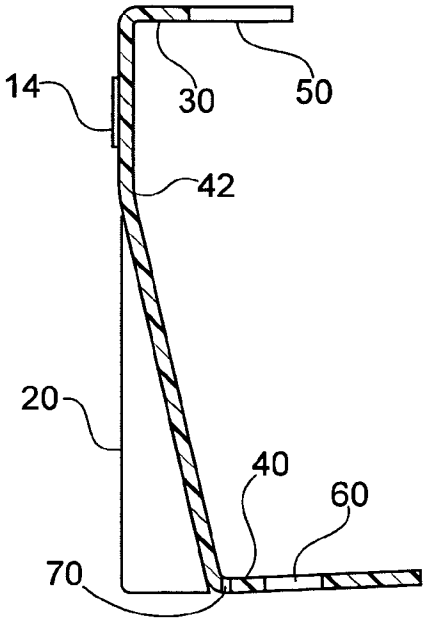
FIG. 1B illustrates a sectional view taken along line A-A of FIG. 1A.
Figure 1C:
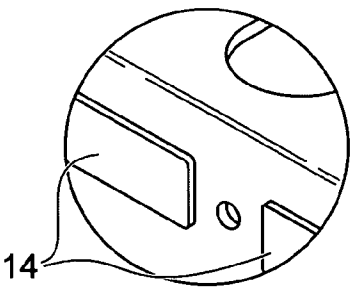
FIG. 1C illustrates a detailed view of wall-mount details of a rear wall.
Figure 1A:
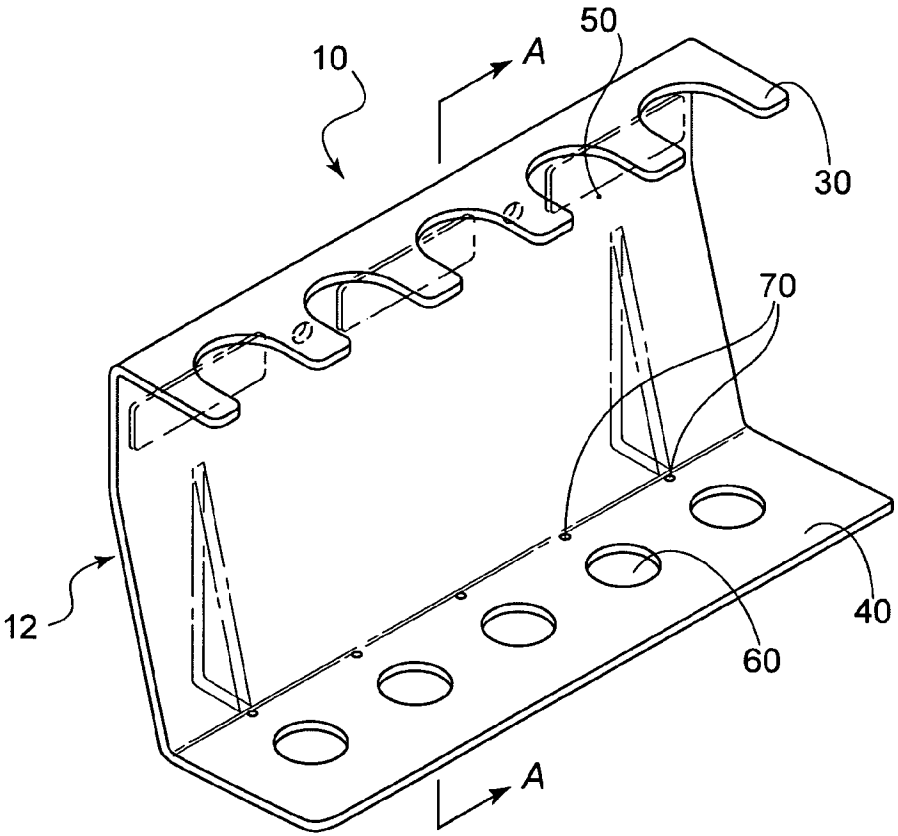
FIG. 1A illustrates an orthogonal view of an embodiment of a toothbrush holder.

As illustrated in FIG. 1A, a holder 10 comprises a planar, inclined bottom wall 40, a rear wall 12, and a top wall 30. The front edge of top wall 30 includes a plurality of recesses 50 that are preferably arcuate. The top wall 30 is spaced from the bottom wall 20 by a distance or height less than the length of a toothbrush it is meant to accommodate, but greater than the height of the center of gravity of such a toothbrush. As such, a holder 10 designed for short, juvenile toothbrushes could be relatively short in height whereas a holder 10 designed for longer, battery-powered toothbrushes could be longer. However, it has been found that a distance between a recess and a corresponding retention cavity of between 10 cm and 12 cm will typically be able to handle the majority of commercially-available toothbrushes and that distances should usually be between 9 cm and 14 cm.

The bottom wall 40 preferably includes a plurality of retention cavities 60 corresponding to, and in vertical registration with, each recess 50. In preferred embodiments, each retention cavity 60 is formed as a through hole, a non-through hole, or a concave indentation. In use, non-through holes or concave indentations may be preferable when the unit is wall mounted to prevent any drainage from dripping through onto other surfaces. When holes are used as retention cavities 60 for wall-mounted embodiments, the holes should preferably be small enough to prevent the handle of a manual toothbrush from falling through the hole. For free-standing embodiments, any suitable retention cavities 60 can be used and through-holes can be larger than the width of a manual toothbrush handle since the surface supporting the holder 10 will also support any toothbrush that passes through such a hole. While five retention cavities 60 are illustrated in FIG. 1A to produce a holder 10 for five toothbrushes, other embodiments can use fewer or more retention cavities for holding fewer or more toothbrushes, respectively.

The use of a circular hole (through or non-through) for retention cavities 60 has been found to be advantageous for use with battery-powered toothbrushes since the circular shape tends to center the bases of such toothbrushes and the edge of the hole (in combination with an inclined angle of the bottom wall 40) provides sufficient frictional retention forces to prevent the base of the toothbrush from slipping out of the hole, even when wet. However, other retention cavities, including but not limited to, variously-shaped holes and substantially concave conical and hemispherical cavities can also be used.

The bottom wall 40 is inclined at several degrees from horizontal, typically between 5 and 20 degrees, as illustrated more clearly in FIG. 1B. This incline assists in leaning the toothbrush into recess 50 and can help direct draining liquids away from the base of the toothbrush. To further handle liquids that drain from the toothbrush, the bottom wall 40 can also include drain holes 70 at the intersection with the rear wall 12. Again, while a drain hole 70 is illustrated for each retention cavity 60, other embodiments can include fewer or more drain holes 70.

As illustrated in FIG. 1B, a lower portion of rear wall 12 angles up to a transition point 42, where it bends to form a substantially vertical upper portion of the rear wall 12. While the lower portion is illustrated as straight and extending for more than half of the height of the holder 10, embodiments are not meant to be limited to this configuration and can be curved to a transition point 42 at a lower location. The illustrated embodiment, with the relatively high transition point 42, allows sufficient room for attachment of support legs 20. The illustrated legs 20 are triangular with a vertical back edge to allow the holder 10 to be placed flush against a wall, but numerous other configurations are also possible.

In embodiments that can be wall mounted or placed flush against a wall, the substantially vertical upper portion of the rear wall 12 preferably includes attachment means 14. In the illustrated embodiment of FIG. 1B, the attachment means 14 is double-sided adhesive strips. These strips 14 are also illustrated in FIG. 1A and detail FIG. 1C, which further show through holes in this portion of wall that can be used to mount the holder 10 to a wall with fasteners such as screws, nails, picture hangers, hooks, rivets, etc.

If attachment means 14 are not provided on the holder 10, the substantially vertical upper portion of the rear wall 12 can still be used with external means, such as mirror clips or adhesive, to attach the holder to a vertical wall surface.

As illustrated in FIGS. 1A and 1B, the recesses 50 in the front edge of top wall 30 are in vertical registration with, but horizontally offset to be slightly behind the retention cavities 60. This allows a toothbrush to be leaned into a recess 50 to be stored in a substantially upright position without requiring the toothbrush to be balanced on its end. In this position, the head of the toothbrush will not contact possibly-contaminated surfaces. The preferably arcuate shape of the recesses 50 act to center a toothbrush to keep it from leaning into an adjacent toothbrush and further allow the holder 10 to accommodate both narrow and thick portions of a toothbrush. Further, the dimensions of the walls and relative locations of the recesses 50 and retention cavities 60 should be chosen to preferably support the head of a toothbrush above the top wall 30 and prevent the head from contacting any vertical walls behind the holder 10.

In preferred embodiments, the bottom wall 40, rear wall 12, and top wall 30 are formed from a single piece of bent or shaped sheet material. Sheet material suitable for the invention includes, but is not limited to, clear acrylic, frosted or satin-finished acrylic, colored acrylic, textured acrylic, brushed aluminum, polished aluminum, brushed stainless steel, polished stainless steel, brushed nickel, polished brass, brushed brass, antique brass, copper, plastic, rubber, wood, clay, and ceramic. Legs 20 are preferably formed from the same sheet material and glued, brazed, or welded to back wall 12. Preferred materials should be non-porous (so clay would include glazing, e.g.) and easily cleaned for purposes of hygiene. The materials should also be resistant to bleaching compounds found in bathroom cleansers and toothpastes.

Because it is desirable for toothbrush holders to be placed in a convenient location in a bathroom, the aesthetics and versatility of placement are important to consumers. The embodiment illustrated herein, especially when formed of an attractive material such as clear acrylic, wood, or ornamental metal, is aesthetically pleasing and can be placed in a wide variety of locations due to the holder's ability to be free standing, to be wall mounted, and to be stood adjacent to a wall where it can both be supported by a horizontal surface and secured to a vertical surface.

A toothbrush holder has been described. It will be understood by those skilled in the art that the present invention may be embodied in other specific forms without departing from the scope of the invention disclosed and that the examples and embodiments described herein are in all respects illustrative and not restrictive. For example, the walls of present invention could be formed of separate components or the legs could be removable or folding without departing from the scope of the invention. Those skilled in the art of the present invention will recognize that other embodiments using the concepts described herein are also possible. Further, any reference to claim elements in the singular, for example, using the articles "a," "an," or "the" is not to be construed as limiting the element to the singular.

What is claimed is:

1. A toothbrush holder, comprising:

an inclined base wall positioned in use at an angle between 5 and 20 degrees from horizontal:

at least one retention cavity formed in the inclined base wall;

a rear wall connected to the inclined base wall, wherein the rear wall includes a first angled portion adjacent the inclined base wall and a transition point where the rear wall changes angle to a substantially-vertical upper portion;

at least one support leg extending from the rear wall on a side opposite the inclined base wall;

a top wall connected to the upper portion of the rear wall, wherein the top wall includes a front edge opposite the rear wall;

at least one drain hole at a junction of the inclined base wall and the first angled portion of the rear wall;

at least one recess in the front edge of the top wall, wherein the recess is in vertical registration with a corresponding retention cavity, but is horizontally positioned closer to the upper portion of the rear wall than the corresponding retention cavity.

2. The toothbrush holder of claim 1, wherein the at least one retention cavity is a circular hole.

3. The toothbrush holder of claim 1, wherein the at least one recess is arcuate.

4. The toothbrush holder of claim 1, wherein the substantially-vertical upper portion of the rear wall further comprises attachment means for securing the holder to a vertical surface.

5. The toothbrush holder of claim 4, wherein the attachment means comprises a double-sided adhesive strip.

6. The toothbrush holder of claim 4, wherein the attachment means comprises a hole for use with a fastener.

7. The toothbrush holder of claim 1, wherein the rear wall is dimensioned to provide a linear distance between a recess and a corresponding retention cavity of between 9 cm and 14 cm.

8. The toothbrush holder of claim 1, wherein the rear wall is dimensioned to provide a linear distance between a recess and a corresponding retention cavity of between 10 cm and 12 cm.

9. The toothbrush holder of claim 1, wherein the inclined base wall, the rear wall, and the top wall are formed from a single sheet of bent material.

10. The toothbrush holder of claim 9, wherein the single sheet of bent material is selected from the group consisting of clear acrylic, frosted or satin-finished acrylic, colored acrylic, textured acrylic, brushed aluminum, polished aluminum, brushed stainless steel, polished stainless steel, brushed nickel, polished brass, brushed brass, antique brass, copper, plastic, rubber, wood, clay, and ceramic.

11. The toothbrush holder of claim 1, wherein the at least one support leg comprises a pair of support legs.

12. The toothbrush holder of claim 11, wherein the support legs are triangular.

13. The toothbrush holder of claim 1, comprising a plurality of recesses and corresponding retention cavities.

* * * * *